US006202828B1

(12) United States Patent
Roskam

(10) Patent No.: US 6,202,828 B1
(45) Date of Patent: Mar. 20, 2001

(54) APPARATUS FOR TURNING PRODUCT AT RIGHT ANGLES

(76) Inventor: Mervin W. Roskam, 5183 Greystone Way, Hoover, AL (US) 35242

( * ) Notice: Subject to any disclaimer, the term of this patent is extended or adjusted under 35 U.S.C. 154(b) by 0 days.

(21) Appl. No.: 09/187,593

(22) Filed: Nov. 6, 1998

Related U.S. Application Data

(60) Provisional application No. 60/064,608, filed on Nov. 7, 1997.

(51) Int. Cl.[7] ..... B65G 47/26
(52) U.S. Cl. ..... 198/457.03
(58) Field of Search ..... 198/457.03

(56) References Cited

U.S. PATENT DOCUMENTS

| | | | | |
|---|---|---|---|---|
| 3,608,895 | * | 9/1971 | Kalven | 198/457.03 |
| 4,193,491 | * | 3/1980 | James et al. | 198/457.03 |
| 4,986,730 | * | 1/1991 | Wetter | 198/457.03 |

* cited by examiner

*Primary Examiner*—Douglas Hess
*Assistant Examiner*—Bryan Jaketic

(74) *Attorney, Agent, or Firm*—Thomas, Kayden, Horstemeyer & Risley LLP

(57) ABSTRACT

A conveyor drop turn system for reorienting product through redirection of product flow at a substantially perpendicular angle includes a first product supply conveyor that, with the assistance of a vacuum control system, delivers product to a second conveyor that is substantially perpendicular to the first product supply conveyor. In accordance with an aspect of the drop turn system, a third spreader conveyor is interposed between the first product supply conveyor and the second conveyor that can be adjusted to cause product to separate in a conveyance direction defined by the second conveyor. More specifically, the third spreader conveyor includes a plurality of endless belts that can be terminated to a variety of positions on a pair of cylindrical pulleys. Through an appropriate arrangement of the belts on the pulleys, product flow can be delivered directly or an offset can be introduced by angling the belts between the pulleys. This offset allows the spreader conveyor to begin separating the product in the direction defined by the second conveyor before the product is transferred to the second conveyor. In accordance with another aspect of the drop turn system, the vacuum control system maintains the product in a stable stream until an individual unit is ready for transfer, in its entirety, to the second conveyor.

16 Claims, 7 Drawing Sheets

APPARATUS FOR TURNING PRODUCT AT RIGHT ANGLES

CROSS REFERENCE TO RELATED APPLICATION

This application claims the benefit of U.S. Provisional Application No. 60/064,608, entitled "Apparatus For Turning Product At Right Angles," filed Nov. 7, 1997, which is incorporated herein by reference.

BACKGROUND OF THE INVENTION

The present invention relates generally to the field of automated conveyor systems, and, more particularly, to conveyor systems used for changing the direction and orientation of transported product.

For mass production of printed media, conveyor systems are used to transport product between workstations where a variety of operations are performed as part of the production process. It is often necessary, however, to position the product on the conveyor system in a particular orientation to facilitate the execution of a particular operation. Consider paper products, for example. Product is conveyed out of the folding unit of a printing press with the fold on the side. That is, the fold is parallel with the transport direction. When the product is delivered to a stacking machine or for one of the operations of an in-line trimming machine, however, the folded edge must be leading (i.e., perpendicular to the transport direction). To perform this reorientation, drop turn systems are used in which a conveyor is positioned at a right angle to the transport conveyor carrying the product stream to reorient the product stream through redirection.

Existing conveyor systems used in reorienting product through product flow redirection suffer from the disadvantage that product often becomes misaligned or unevenly distributed during the 90° transfer. Product distribution can be critical depending on the application. For example, stacking machines include a counting device to ensure the stack is quantisized properly. If product units overlay one another, the count generated will be incorrect resulting in an inaccurate stack to be delivered to a customer. If too much product is contained in a stack, excess printing cost is incurred. If too little product is in a stack, all customers may not be served. If product is severely misaligned, the stacking machine could jam resulting in increased maintenance costs. Similar jams can occur in in-line trimmers.

Generally, alignment problems are most acute when the drop turn system is running very slow. Under slow speed, product tends to roll or misalign during the transfer from one conveyor to a perpendicular conveyor. Existing drop turn systems have been ineffective at reorienting product streams running at slow speed without incurring frequent alignment problems. Additionally, when running at very high speeds, a traditional drop turn system can also fail.

Accordingly, there exists a need for a conveyor system capable of changing product orientation through redirection of product flow at right angles that overcomes the aforementioned disadvantages of prior art systems.

SUMMARY OF THE INVENTION

Certain objects, advantages and novel features of the invention will be set forth in part in the description that follows and in part will become apparent to those skilled in the art upon examination of the following or may be learned with the practice of the invention.

To achieve the advantages and novel features, the present invention is generally directed to a conveyor drop turn system for reorienting product through redirection of product flow at a substantially perpendicular angle. The drop turn system is comprised of a first product supply conveyor that, with the assistance of a vacuum control system, delivers product to a second conveyor that is substantially perpendicular to the first product supply conveyor.

In accordance with an aspect of the present invention, a third spreader conveyor is interposed between the first product supply conveyor and the second conveyor that can be adjusted to cause product to separate in a conveyance direction defined by the second conveyor. More specifically, the third spreader conveyor comprises a plurality of endless belts that can be terminated to a variety of positions on a pair of cylindrical pulleys. Through an appropriate arrangement of the belts on the pulleys, product flow can be delivered directly or an offset can be introduced by angling the belts between the pulleys. This offset allows the spreader conveyor to begin separating the product in the direction defined by the perpendicular conveyor before the product is transferred to the perpendicular conveyor. This has proven particularly effective for lightweight or flimsy product that tends to overlay itself during the transfer to the perpendicular conveyor.

In accordance with another aspect of the present invention, the vacuum control system maintains the product in a stable stream until an individual unit is ready for transfer, in its entirety, to the second conveyor thereby reorienting the product through redirection at a substantially right angle. This is accomplished by using a vacuum to hold the product in engagement until a unit is ready for transfer to the second conveyor. Thus, a unit is never in contact with both the second conveyor and the first product supply conveyor or the third spreader conveyor at the same time, which can result in undesired twisting and misalignment of the product particularly at slow or very high speeds. Thus, the vacuum control system provides the conveyor drop turn system according to the instant invention with the ability to be used in both high speed and, most importantly, low and very high speed applications where traditional conveyor drop turn systems have been ineffective.

The invention can also be viewed as providing a method for turning product. In this regard, the method can be broadly summarized by the following steps: Product is transported on a first product supply conveyor. The product is then engaged by a vacuum control system and then deposited on a second conveyor that is substantially perpendicular to the first product supply conveyor.

BRIEF DESCRIPTION OF THE SEVERAL VIEWS OF THE DRAWINGS

Other features of the present invention will be more readily understood from the following detailed description of a specific embodiment thereof when read in conjunction with the accompanying drawings, in which.

DETAILED DESCRIPTION OF THE PREFERRED EMBODIMENT

Figure 1:
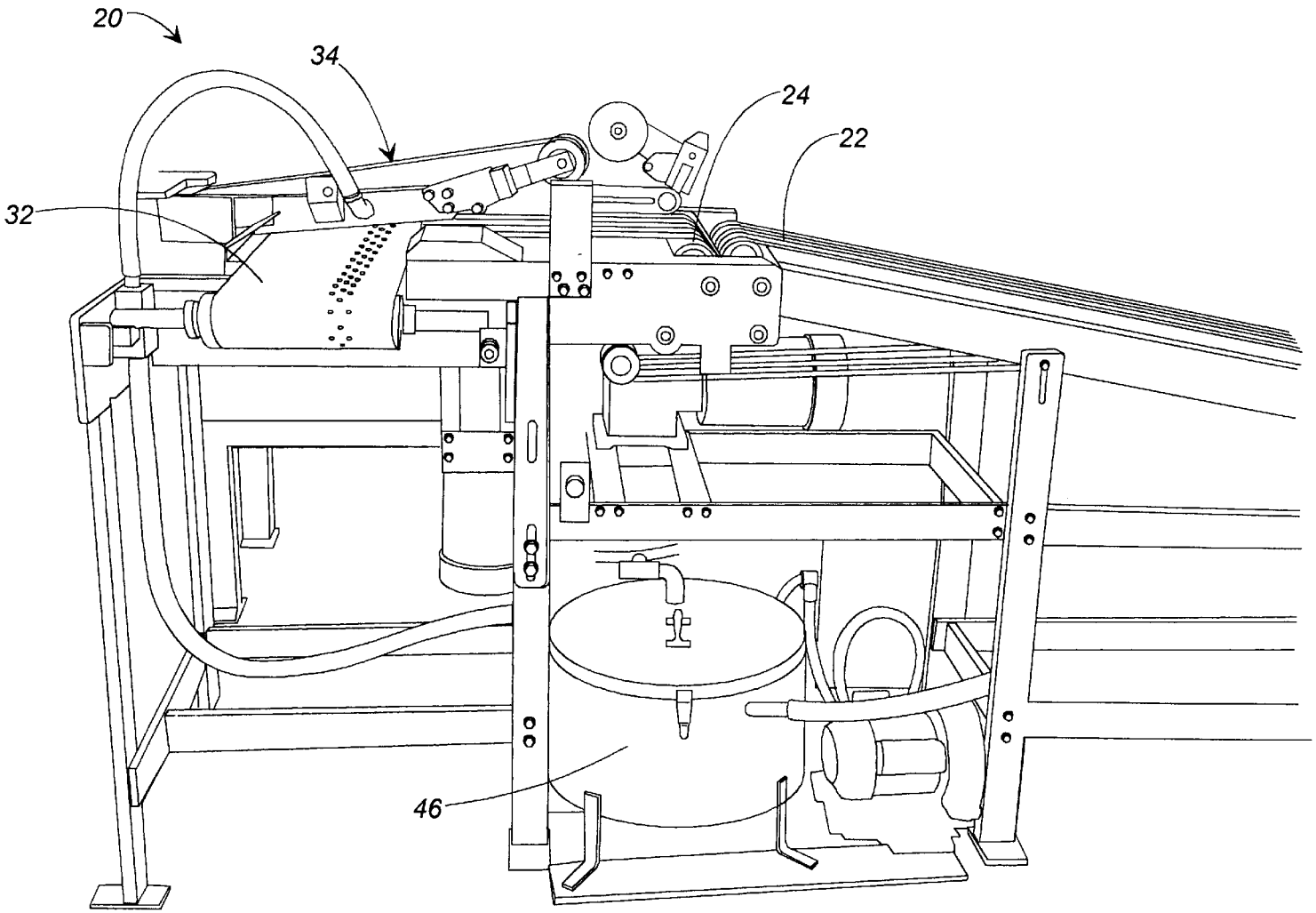
FIG. 1 is a perspective view of a conveyor drop turn system according to the present invention.

While the invention is susceptible to various modifications and alternative forms, a specific embodiment thereof is shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the claims.

Referring now to FIG. 1, a perspective view of a conveyor drop turn system 20 for reorienting product through redirection of product flow at a right angle is shown. Drop turn system 20 is comprised of an infeed or product supply conveyor 22 that supplies product to spreader conveyor 24 that, in turn, delivers product to perforated perpendicular conveyor 32 with the assistance of vacuum control system 34.

Figure 2:
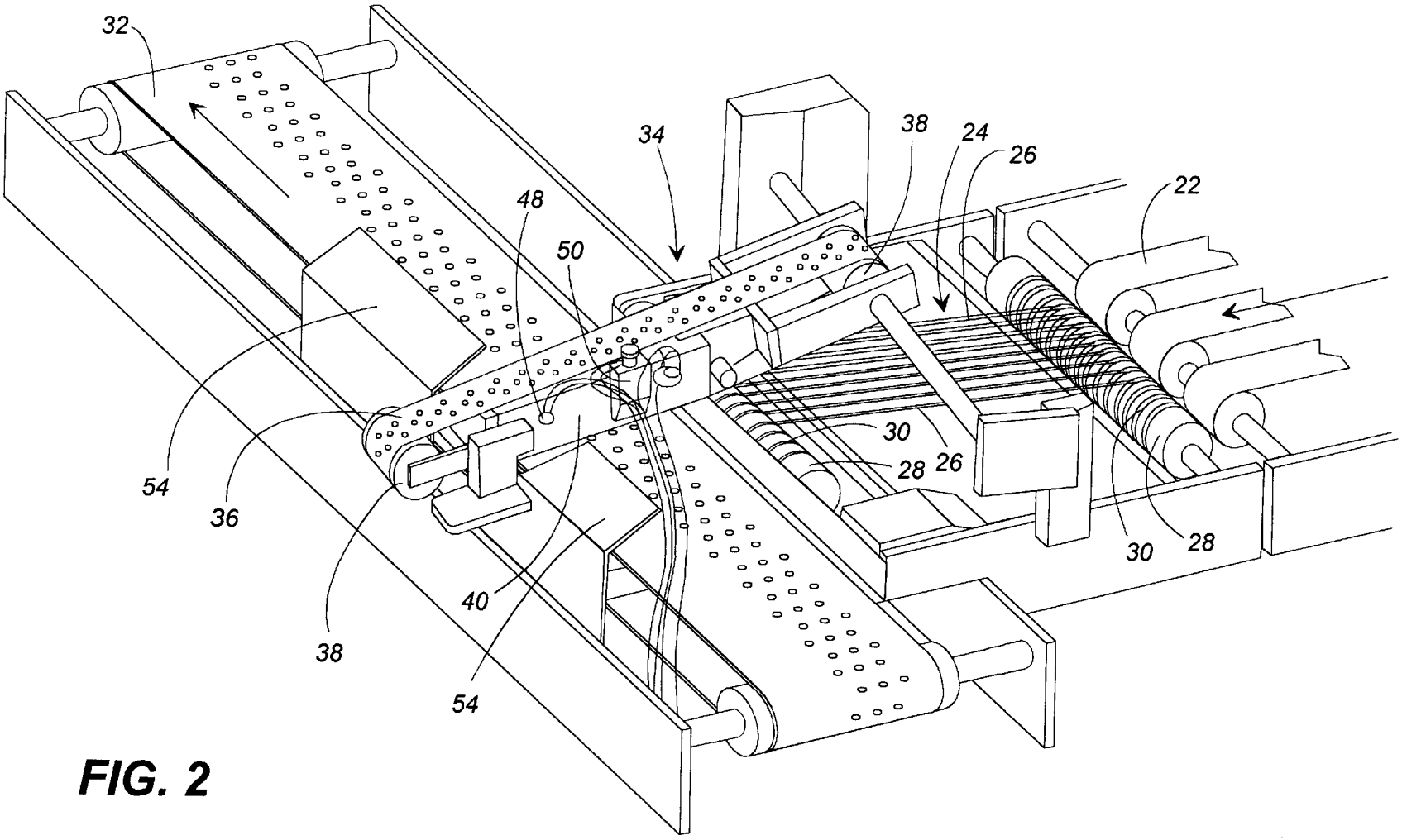
FIG. 2 is a perspective view of the spreader conveyor and vacuum control system used in the conveyor drop turn system of FIG. 1.
Figure 3:
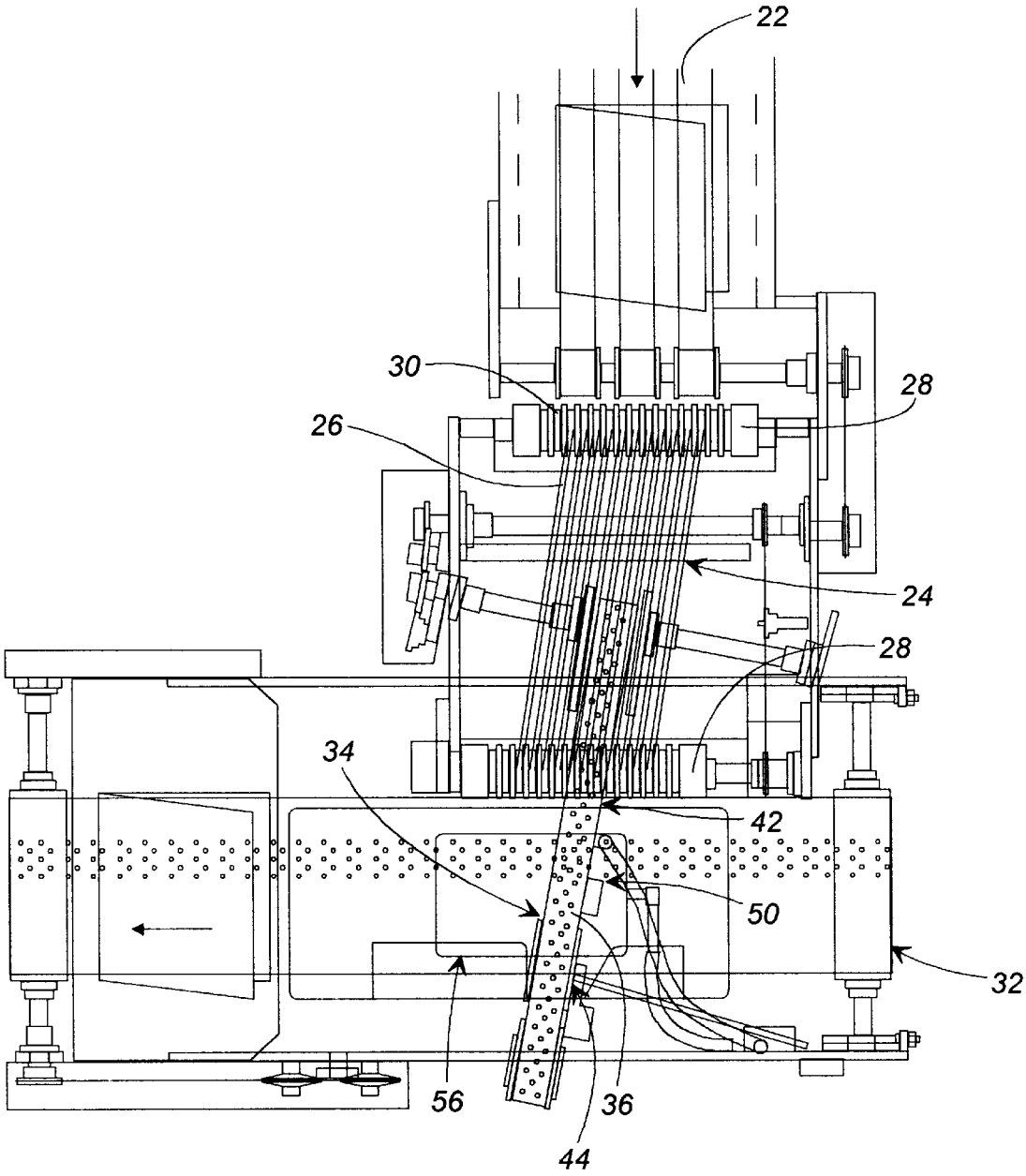
FIG. 3 is a plan view of the spreader conveyor and vacuum control system used in the conveyor drop turn system of FIG. 1.

Shown best in FIGS. 2 and 3, spreader conveyor 24 comprises a plurality of endless round belts 26 driven by pulleys 28. Advantageously, pulleys 28 are designed with a plurality of grooves 30 for receiving round belts 26. This allows round belts 26 to be arranged in either a straight or an offset alignment such that the two grooves 30 terminating an individual round belt 26 do not define a line parallel with product supply conveyor 22. Through this offset arrangement, spreader conveyor 24 will introduce a separation in the products that is perpendicular to the direction in which the products are conveyed by product supply conveyor 22. The magnitude of this separation can be controlled by the amount of offset designed into spreader conveyor 24. Generally, spreader conveyor 24 will be configured with no offset for thicker or heavier product because such product separates naturally onto perpendicular conveyor 32 because of their own inherent stability. For lightweight, thin or flimsy product, however, spreader conveyor 24 is preferably configured with an appropriate offset to begin separating product in the direction defined by perpendicular conveyor belt 32 to ensure a proper distribution of product on perpendicular conveyor belt 32. It will be appreciated that spreader conveyor 24 provides great flexibility in that it allows drop turn system 20 to process product across a broad range of thickness and weight, including very thin or flimsy product.

Figure 4:
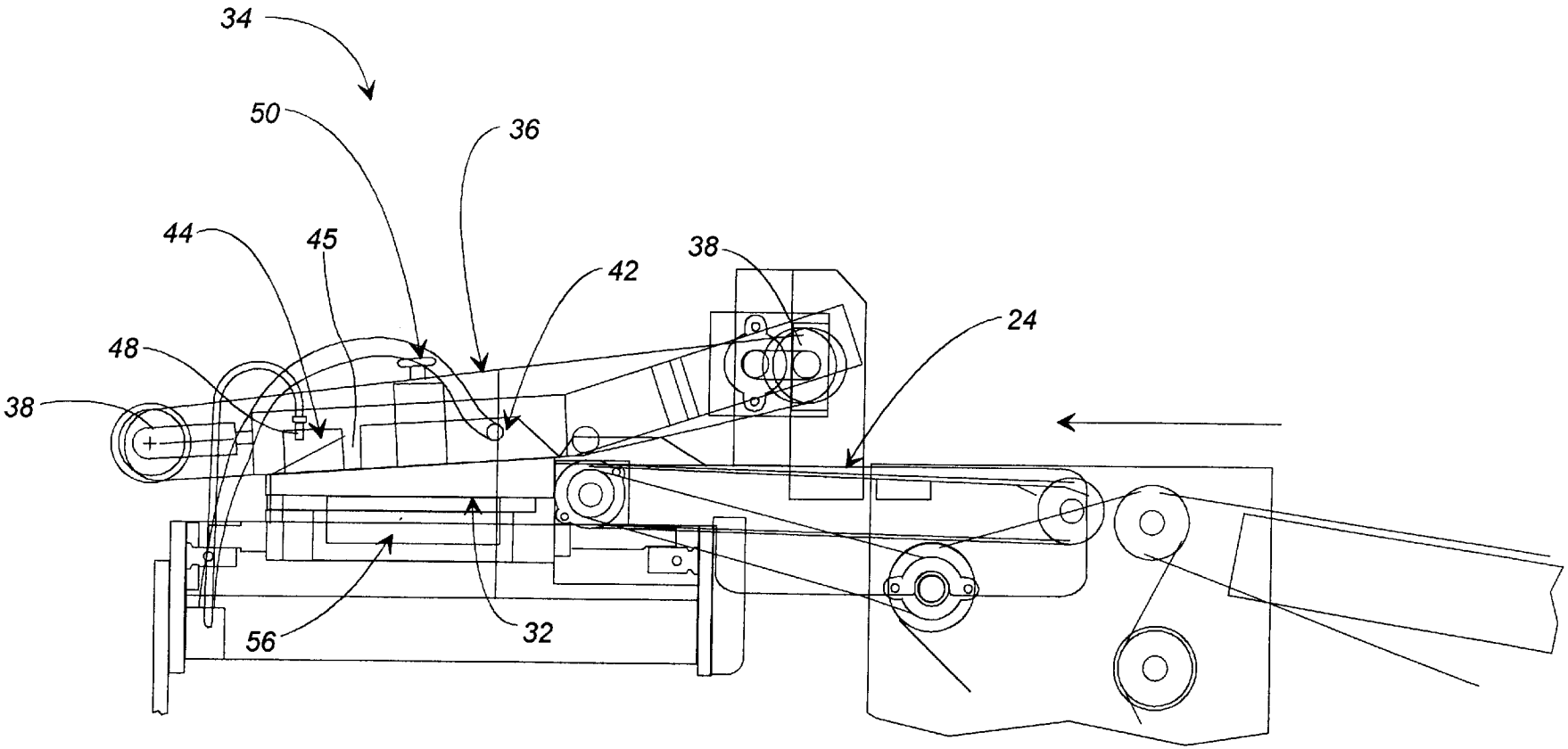
FIG. 4 is an elevation view of the vacuum control system used in the conveyor drop turn system of FIG. 1.

Spreader conveyor 24 advances product towards perpendicular conveyor 32; however, before product reaches perpendicular conveyor 32, it is engaged by vacuum control system 34 as shown best in FIGS. 2, 3, and 4. Vacuum control system 34 comprises an endless perforated belt 36 supported by idler/driver pulleys 38 that cycles around a vacuum housing 40. Vacuum housing 40 is manufactured from nylon and is machined to define two internal chambers: vacuum chamber 42 and low-vacuum and/or pressure chamber 44 (see FIG. 4). The two chambers are separated by an adjustable nylon block 45 so that the size of the chambers can be adjusted as necessary to control the vacuum generated according to the requirements of a given product. Vacuum is supplied by means of a regenerative blower 46. Low vacuum and/or pressure chamber 44 is controlled through an adjustable regulator via port 48 shown best in FIGS. 2 and 4. The regulator allows the vacuum/pressure applied in low-vacuum and/or pressure chamber 44 to be easily adjusted for different product lines. To assist low-vacuum and/or pressure chamber 44 in releasing product from vacuum control system 34, air jet 50 is mounted to the side of endless belt 36 and is in communication with low-vacuum and/or pressure chamber 44. At the appropriate release point, air jet 50 will provide a burst of highpressure air to disengage a product from vacuum control system 34.

Figure 5:
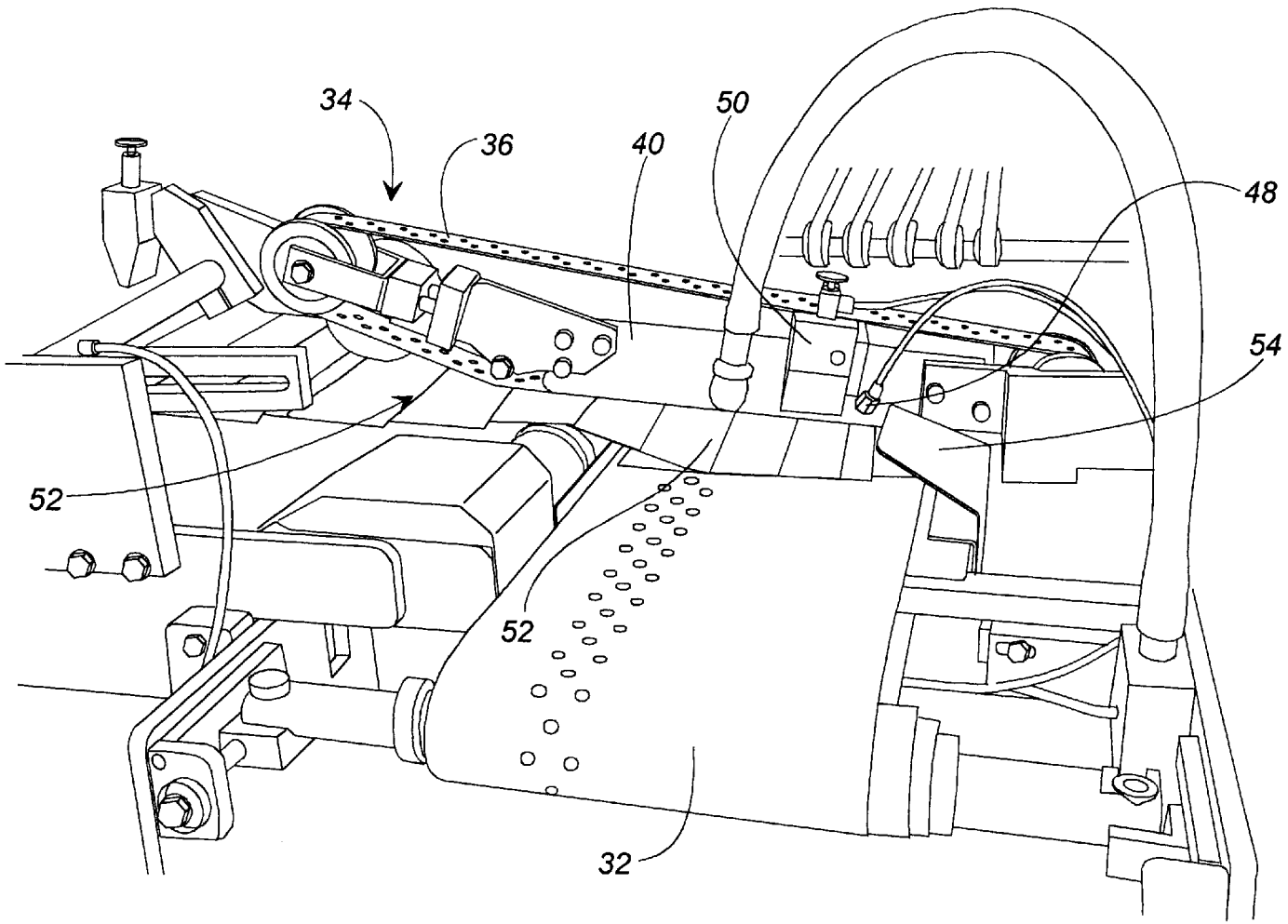
FIG. 5 is a perspective view of the conveyor drop turn system of FIG. 1 with the vacuum control system inactive.
Figure 6:
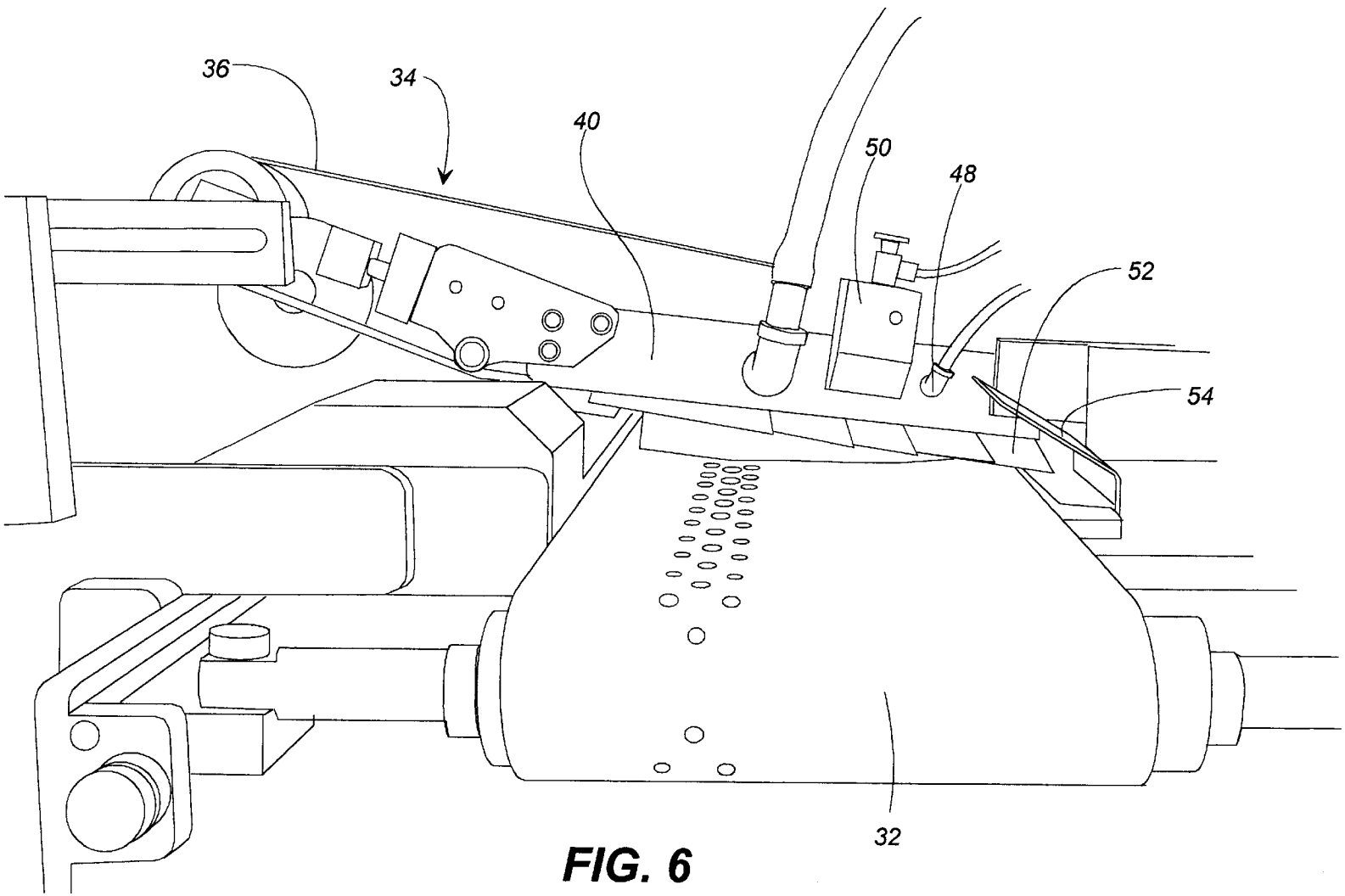
FIG. 6 is a perspective view of the conveyor drop turn system of FIG. 1 with the vacuum control system activated.
Figure 7:
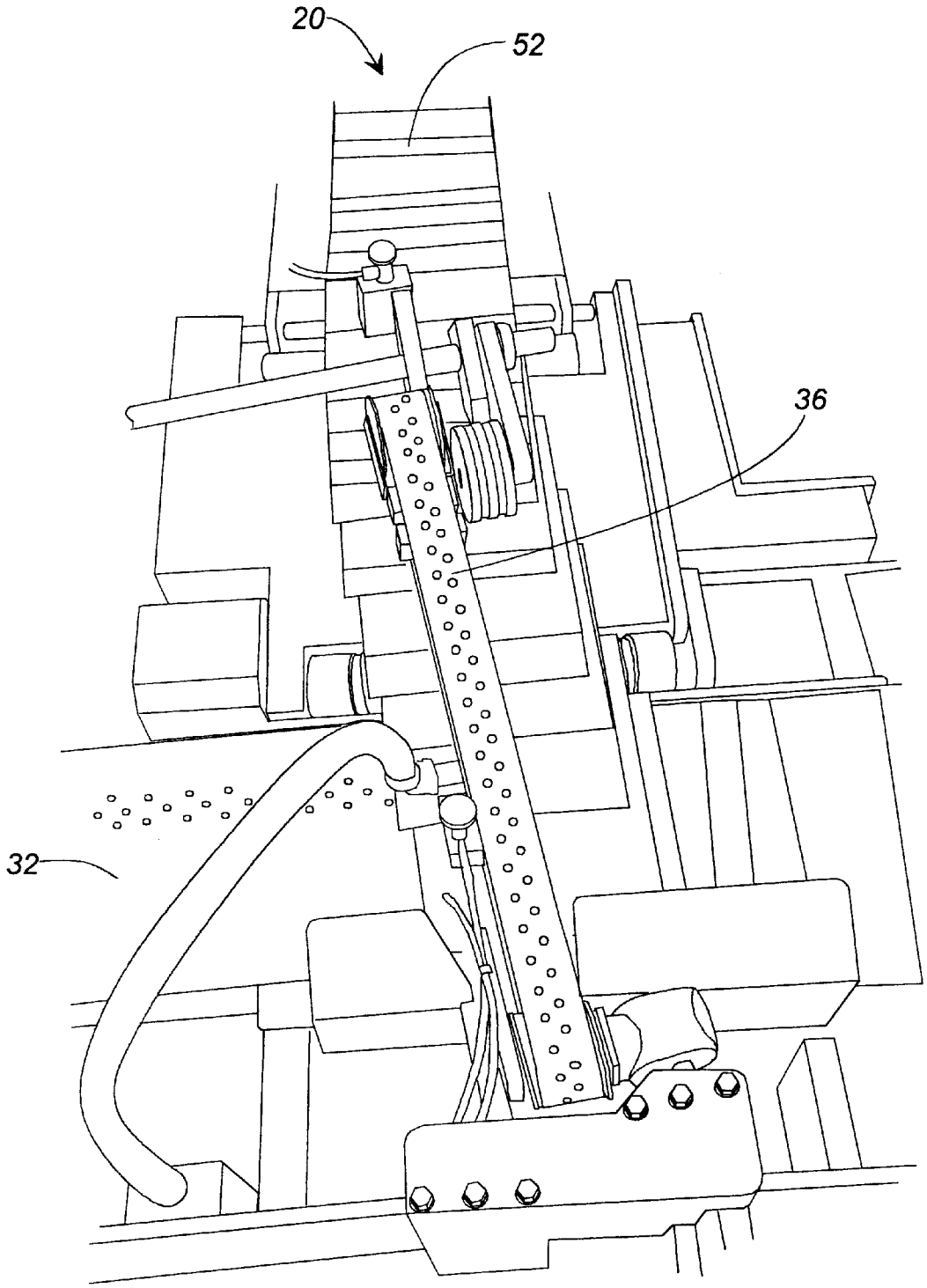
FIG. 7 is a perspective view of the drop turn conveyor system of FIG. 1 depicting reorientation of a product stream through redirection.

The operation of vacuum control system 34 is best understood with reference to FIGS. 5 and 6. FIG. 5 depicts the transfer of thin product 52 from spreader conveyor 24 onto perpendicular conveyor 32 without any vacuum applied through vacuum control system 34. Conversely, FIG. 6 depicts the same transfer of FIG. 5 but with vacuum control system 34 activated. As can be seen in FIG. 5, product 52 tends to overlay upon itself with minimal separation between the units in the direction defined by perpendicular conveyor 32. Turning now to FIG. 6, vacuum control system 34 applies a vacuum through vacuum chamber 42 to suspend product 52 above perpendicular belt 32 until it reaches stainless steel stop plate 54 where it is then released. Vacuum control system 34 releases product through low-vacuum and/or pressure chamber 44 with optional assistance from air jet 50. Specifically, as product is advanced by endless belt 36, it is held tight against endless belt 36 by vacuum from vacuum chamber 42. However, once the product reaches low-vacuum and/or pressure chamber 44, the weight of a product unit overcomes any low-vacuum applied and the product is released to perpendicular conveyor 32. Alternatively, air jet 50 can be used to insert a burst of high pressure air into low-vacuum and/or pressure chamber 44 to eliminate any vacuum and force product down onto perpendicular conveyor 32.

Essentially, vacuum control system 34 maintains product in a stable stream until an individual unit is ready for transfer, in its entirety, to perpendicular conveyor 32 thereby reorienting the product through redirection at a right angle. This should be contrasted with the example shown in FIG. 5 where product is transferred to perpendicular conveyor 32 gradually thereby allowing the individual units to become twisted during the time when they are in contact with both perpendicular conveyor 32 and spreader conveyor 24. It will be appreciated that the twisting and misalignment will be particularly troublesome when perpendicular conveyor 32 and spreader conveyor 24 are running at slow speed because the time an individual unit is in contact with both conveyors is maximized. In very high speed applications, the product tends to "float" during the transfer from spreader conveyor 24 to perpendicular conveyor 32 because the product is not controlled. Thus, vacuum control system 34 provides drop turn system 20 with the ability to be used in both very high speed and low speed applications where traditional drop turn systems have been ineffective.

Finally, regenerative blower 46 (see FIG. 1) supplies a vacuum to vacuum control system 34 and to perpendicular conveyor 32 through vacuum chamber 56 as shown in FIG. 4. The vacuum applied to perpendicular conveyor 32 facilitates reception of product from vacuum control system 34 and prevents product from shifting once it has been received.

FIG. 6 illustrates drop turn system 20 in operation. While the product shown is a magazine, as used herein, product refers most generally to any item possessing sufficient geometric and weight characteristics to lend itself to manipulation via the vacuum assisted conveyor system described in the foregoing. Examples of such items include, but are not limited to, cardboard, magazines, newspapers, newspaper supplements, flyers, press signatures and soft-cover books.

In concluding the detailed description, it should be noted that it will be obvious to those skilled in the art that many variations and modifications may be made to the preferred embodiment without substantially departing from the principles of the present invention. For example, in the embodiment disclosed herein, conveyor 32 and conveyor 22 are perpendicular to one another. The present invention, however, can also be used to transfer product between conveyors that are positioned at oblique angles to one another. All such variations and modifications are intended to be included herein within the scope of the present invention, as set forth in the following claims.

I claim:

1. A conveyor drop turn system, comprising:

a first conveyor carrying product thereon;

a second conveyor positioned substantially perpendicular to said first conveyor and receiving said product therefrom; and a vacuum control system having an internal chamber for transferring said product from said first conveyor to said second conveyor such that said product does not engage said first conveyor and said second conveyor simultaneously, said internal chamber comprising first and second chambers that are maintained at different pressures during operation.

2. The system of claim 1, further comprising:

a third conveyor interposed between said first conveyor and said second conveyor for delivering product to said vacuum control system, said third conveyor comprising:

a plurality of endless belts; and a pair of pulleys each having a plurality of positions defined thereon for terminating said belts.

3. The system of claim 2, wherein said plurality of belts are terminated at said plurality of positions such that said third conveyor is substantially parallel with said first conveyor.

4. The system of claim 2, wherein said plurality of belts are terminated at said plurality of positions such that said third conveyor forms an oblique angle with said first conveyor.

5. The system of claim 1, wherein said vacuum control system comprises:

a vacuum housing that defines said internal chamber; and an endless belt disposed about said vacuum housing and being supported by a pair of pulleys such that said endless belt cycles around said vacuum housing, said endless belt being perforated for drawing a vacuum therethrough.

6. The system of claim 1, wherein said first chamber comprises a vacuum chamber and said second chamber comprises a low-vacuum chamber and wherein said internal chamber comprises an adjustable block for separating said vacuum chamber from said low vacuum chamber.

7. The system of claim 6, further comprising an air jet mounted to said vacuum housing and in communication with said low-vacuum chamber.

8. The system of claim 6, wherein said second conveyor includes a perforated endless belt for drawing a vacuum therethrough and further comprising:

vacuum supply means in communication with said vacuum housing and said second conveyor for applying a vacuum thereto.

9. The system of claim 1, wherein said first chamber comprises a vacuum chamber and said second chamber comprises a pressure chamber, and wherein said chamber includes an adjustable block for separating said vacuum chamber from said low vacuum chamber.

10. A method for turning product comprising the steps of:

transporting product on a first conveyor;

engaging said product with a first chamber of a vacuum control system, the first chamber being in a vacuum; and depositing said product on a second conveyor with a second chamber of the vacuum control system, the second chamber being at a pressure higher than that of the first chamber, said second conveyor being positioned substantially perpendicular to said first conveyor.

11. The method of claim 10, further comprising the step:

providing a third conveyor between said first and second conveyor for delivering said product to said vacuum control system, said third conveyor comprising:

a plurality of endless belts; and a pair of pulleys each having a plurality of positions defined thereon for terminating said belts.

12. The method of claim 10, further comprising the step of:

separating said product in a conveyance direction defined by said second conveyor.

13. The method of claim 10, wherein said vacuum control system comprises:

a vacuum housing that defines the first and second chambers; and an endless belt disposed about said vacuum housing and being supported by a pair of pulleys such that said endless belt cycles around said vacuum housing, said endless belt being perforated for drawing a vacuum therethrough.

14. The method of claim 10, wherein the first chamber is a vacuum chamber and the second chamber is a low-vacuum chamber and wherein an adjustable block separates said vacuum chamber from said low vacuum chamber.

15. The method of claim 14, wherein said depositing step comprises:

inserting a burst of air into said low-vacuum chamber to disengage said product from said vacuum control system.

16. The method of claim 10, wherein the first chamber is a vacuum chamber and the second chamber is a pressure chamber and wherein an adjustable block separates said vacuum chamber from said low vacuum chamber.

* * * * *